US011278117B2

(12) United States Patent
Dudley

(10) Patent No.: US 11,278,117 B2
(45) Date of Patent: Mar. 22, 2022

(54) SYSTEMS, DEVICES, AND/OR METHODS FOR MANAGING ARTICLES

(71) Applicant: Garrett Dudley, Palmyra, VA (US)

(72) Inventor: Garrett Dudley, Palmyra, VA (US)

( * ) Notice: Subject to any disclaimer, the term of this patent is extended or adjusted under 35 U.S.C. 154(b) by 0 days.

(21) Appl. No.: 16/935,100

(22) Filed: Jul. 21, 2020

(65) Prior Publication Data

US 2021/0015254 A1 Jan. 21, 2021

Related U.S. Application Data

(60) Provisional application No. 62/876,706, filed on Jul. 21, 2019.

(51) Int. Cl.
*A47B 81/00* (2006.01)
*A47B 46/00* (2006.01)
*A47B 67/02* (2006.01)

(52) U.S. Cl.
CPC ..... *A47B 81/005* (2013.01); *A47B 46/00* (2013.01); *A47B 67/02* (2013.01)

(58) Field of Classification Search
CPC ..... A47B 67/00; A47B 67/005; A47B 61/02; A47B 67/02; A47B 2067/025; A47B 81/00; A47B 81/005; A47B 96/1425
See application file for complete search history.

(56) References Cited

U.S. PATENT DOCUMENTS 4,304,447 A * 12/1981 Ellwood ..... A45C 11/16 312/204
4,936,038 A * 6/1990 Johnson ..... A47B 81/005 211/64
5,810,462 A * 9/1998 Lee ..... F25D 25/027 312/405.1
9,888,771 B2 * 2/2018 Suggs ..... E05G 1/024
9,963,927 B1 * 5/2018 Dudley ..... E05G 1/026

* cited by examiner

*Primary Examiner* — Andrew M Roersma

(74) *Attorney, Agent, or Firm* — Dale Jensen, PLC; Dale Jensen

(57) ABSTRACT

Certain exemplary embodiments can provide a cabinet that comprises a cover, a base, a rotatable rod coupled to the base, a gun prong coupled to the rotatable rod, a prong magnet coupled to the gun prong, and a base magnet. Wherein, when the cover is opened to a predetermined position, the rotatable rod rotates to expose an Article placed on the gun prong. The rotation of the rotatable rod can be caused by repulsion between the prong magnet and the base magnet.

15 Claims, 5 Drawing Sheets

SYSTEMS, DEVICES, AND/OR METHODS FOR MANAGING ARTICLES

CROSS-REFERENCES TO RELATED APPLICATIONS

This application claims priority to, and incorporates by reference herein in its entirety, U.S. Provisional Patent Application Ser. No. 62/876,706, filed Jul. 21, 2019.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a cabinet that comprises a cover, a base, a rotatable rod coupled to the base, a gun prong coupled to the rotatable rod, a prong magnet coupled to the gun prong, and a base magnet. Wherein, when the cover is opened to a predetermined position, the rotatable rod rotates to expose an Article placed on the gun prong. The rotation of the rotatable rod can be caused by repulsion between the prong magnet and the base magnet.

Certain exemplary embodiments provide a cabinet that can be used to store certain articles in a concealed manner. For example, a user of the cabinet can store a firearm such as handgun in the cabinet. The firearm stored in the cabinet will remain substantially concealed in the cabinet until a cover of the cabinet is raised above a predetermined level. A rotatable gun prong holds the article (e.g., handgun) and is constructed to swing forward when the cover of the cabinet is raised above a predetermined level. For example, the gun prong can be mounted to the cabinet via dowel pins or any other method allowing the gun prong to swing forward when the cover is lifted. The gun prong comprises a first magnet, which is attracted to a metal component (e.g., a screw) when the cover is opened. The first magnet also assists in retaining a gun on the gun prong when the gun barrel is magnetic. The gun prong is repelled by a second magnet of opposite polarity coupled to the cabinet. The repulsion of the first magnet by the second magnet further impels the gun prong to rotate when the cabinet is opened.

Figure 1:
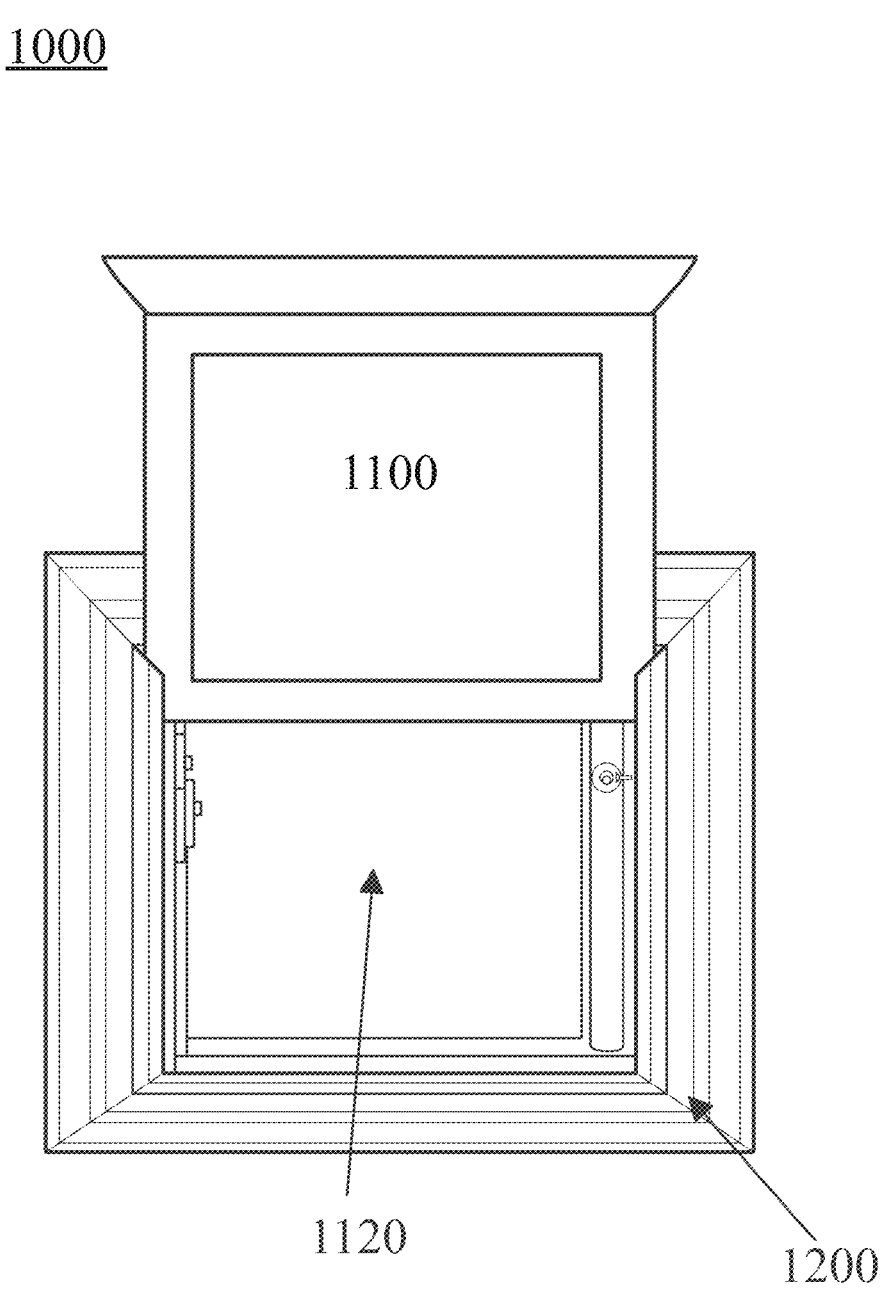
FIG. 1 is a frontal view of an exemplary embodiment of a cabinet 1000.

FIG. 1 is a frontal view of an exemplary embodiment of a cabinet 1000, which comprises a cover 1100 and a base 1200. Cover 1100 and base 1200 can be slidably coupled via a tongue and groove design. Cabinet 1000 defines an aperture 1120. Cabinet 1000 can be utilized to conceal the article (e.g., handgun).

Figure 2:
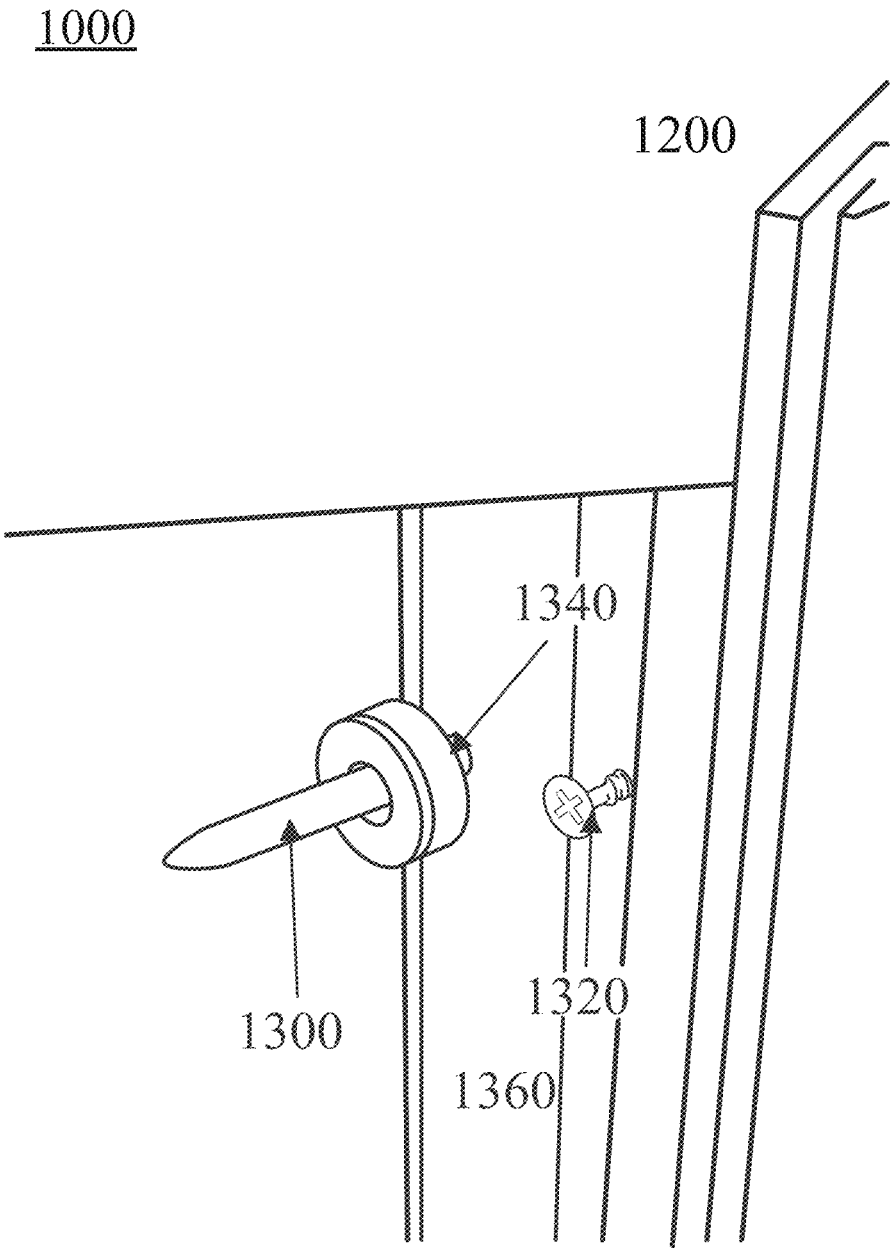
FIG. 2 is a perspective view of a portion of cabinet 1000 with a cover open.

FIG. 2 is a perspective view of a portion of cabinet 1000 with a cover open, which shows base 1200 and of cabinet 1000 in which articles can be stored. Gun prong 1300 is coupled to a rotatable rod 1360. Rotatable rod 1360 is rotatable in base 1200, which allows gun prong 1300 to swing when cover 1100 is raised. When cover 1100 (see FIG. 1) is raised, gun prong 1300 swings out exposing an article such that the article can be quickly removed by a user. Gun prong 1300 comprises a prong magnet 1340 that is magnetically attracted to a magnetic piece 1320, which assists in exposing the article. When comprising a component (e.g., a gun barrel) that is attracted to prong magnet 1340, prong magnet 1340 assists in restraining the article on gun prong 1300.

Figure 3:
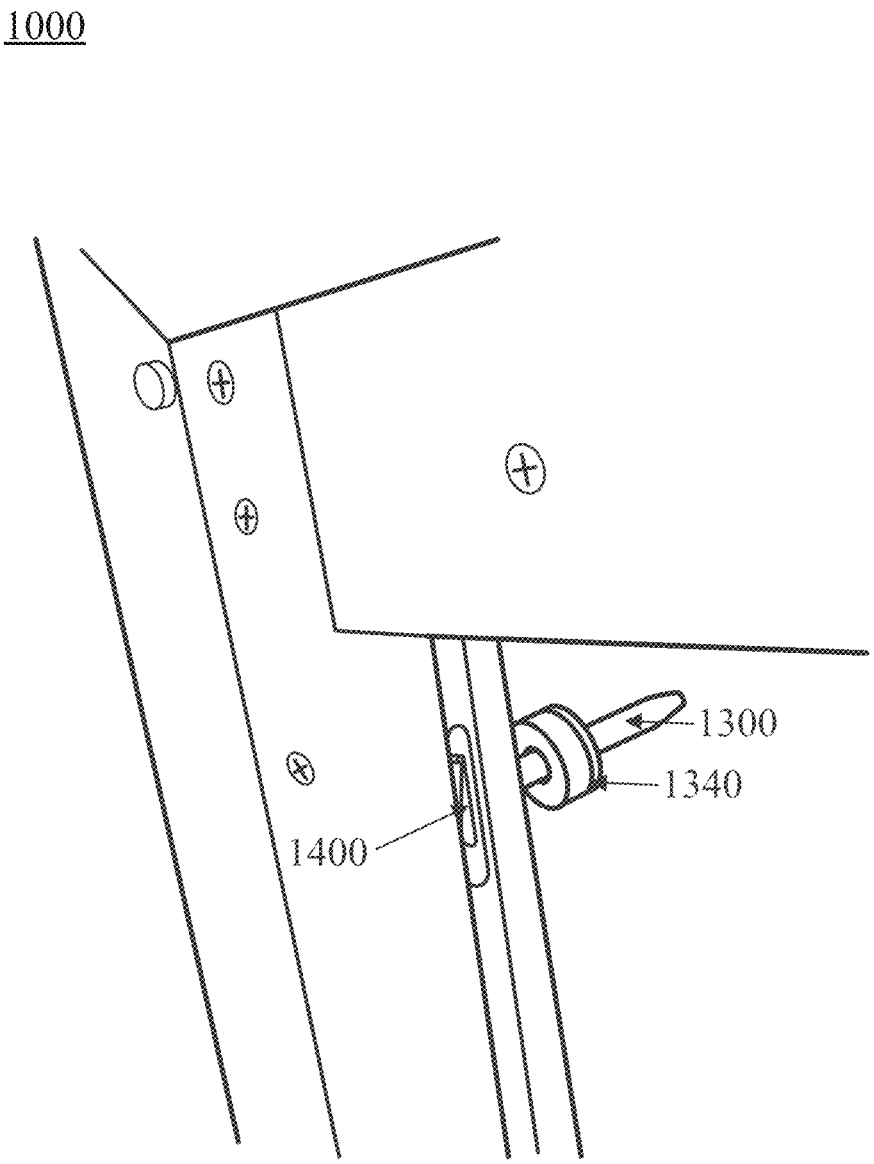
FIG. 3 is a perspective view of a portion of cabinet 1000 with the cover open.

Cabinet 1000 can comprise:

cover 1100;

base 1200;

rotatable rod 1360 coupled to base 1200;

gun prong 1300 coupled to rotatable rod 1360;

prong magnet 1340 coupled to gun prong 1300;

magnetic piece 1320; and a base magnet (see base magnet 1400 illustrated in FIG. 3).

Wherein, when cover 1100 is opened to a predetermined position, rotatable rod 1360 rotates to expose an Article placed on gun prong 1300. The rotation of rotatable rod 1360 is caused by repulsion between prong magnet 1340 and base magnet 1400 and/or attraction between prong magnet 1340 and magnetic piece 1320. In certain exemplary embodiments, magnetic piece 1320 can be a magnet.

The Article can be a firearm. In certain exemplary embodiments, cover 1100 is slidable. In other exemplary embodiments, cover 1100 is rotatable. In certain exemplary embodiments, rotatable rod 1360 is coupled to base 120 via a pair of pins (see, e.g., dowel pins 5400 of FIG. 5). Cabinet 1000 defines aperture 1120. Cover 1100 can engages with base 1200 via a tongue and groove. The Article can be a firearm.

In certain exemplary embodiments, cabinet 1000 resembles a household cabinet. In other exemplary embodiments, cabinet 1000 resembles a picture frame. In other exemplary embodiments, cabinet 1000 resembles a framed mirror.

FIG. 3 is a perspective view of a portion of cabinet 1000 with the cover open. Cabinet 1000 comprises a base magnet 1400, which has an opposing polarity to prong magnet 1340. Having an opposing polarity causes base magnet 1400 to repel prong magnet 1340. The repulsion of prong magnet 1340 by base magnet 1400 impels gun prong 1300 outward when cover 1100 (see FIG. 1) is raised.

Figure 4:
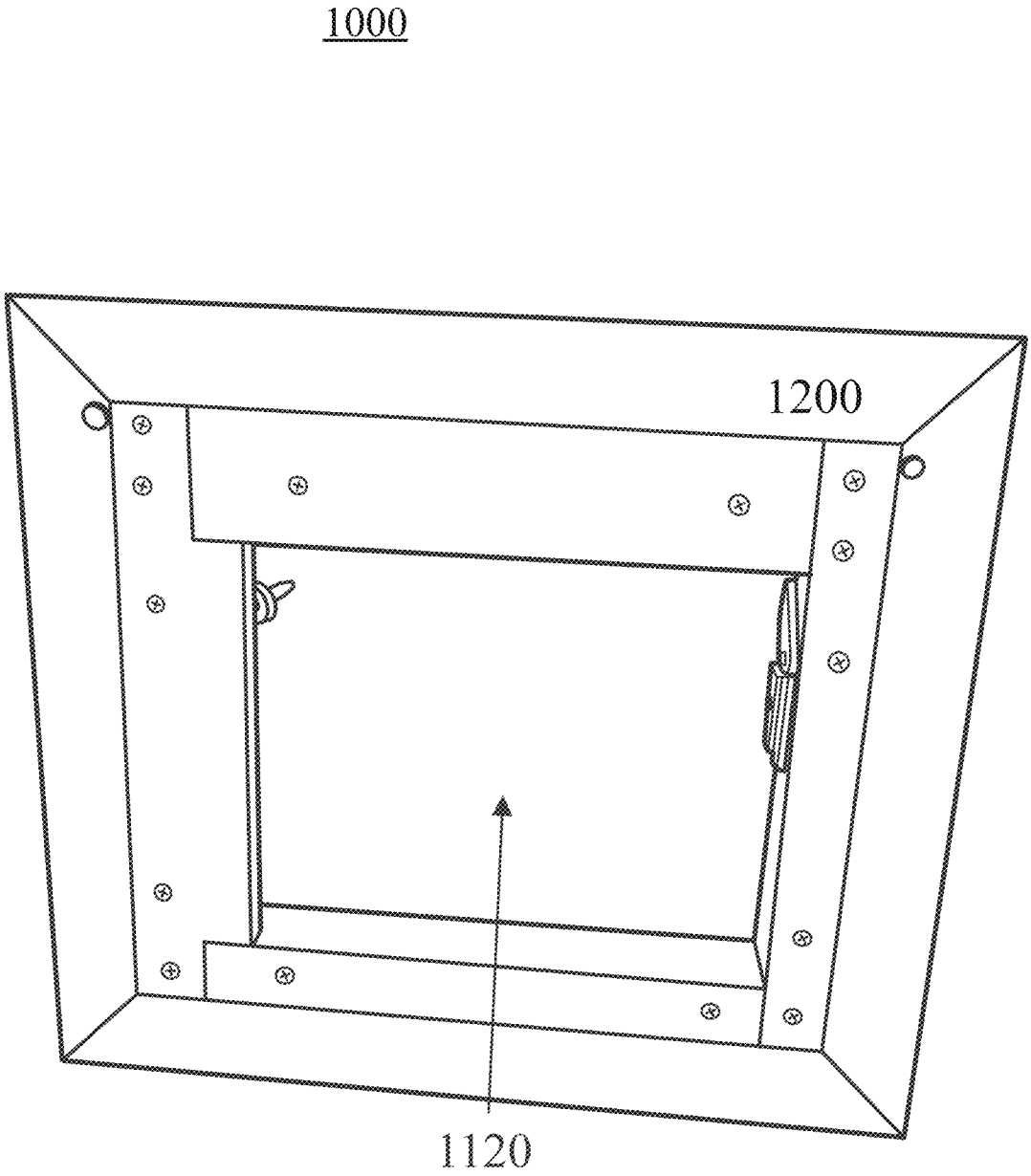
FIG. 4 is a rear view of cabinet 1000 with the cover open.

FIG. 4 is a rear view of cabinet 1000 with the cover removed from base 1200. Aperture 1120 is illustrated with base 1200 removed.

Figure 5:
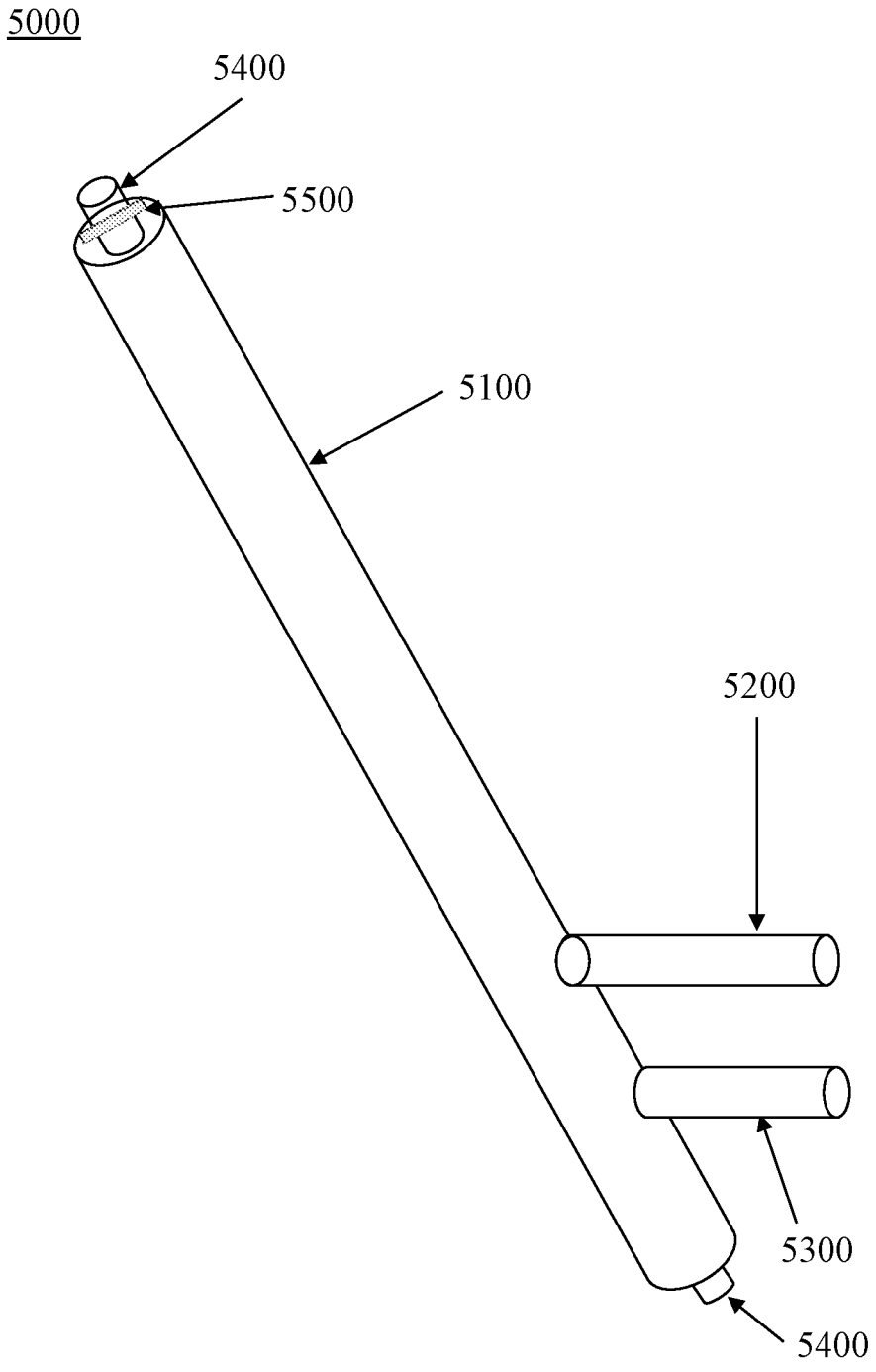
FIG. 5 is a perspective view of a rotatable rod 5000.

FIG. 5 is a perspective view of a rotatable rod 5000, which comprises a primary rod 5100, a gun prong 5200, a door prong 5300, and dowel pins 5400. Door prong 5200 can be coupled to rotatable rod 5000. Door prong 5300 is constructed to restrain a cover (see cover 1100 of FIG. 1) from motion after the cover (see cover 1100 of FIG. 1 is lifted to a predetermined position relative to a base (see base 1200 of FIG. 1). Rotatable rod 5000 can be coupled to an exemplary cabinet with a bearing 5500 on each of dowel pins 5400 to result in a smooth low friction motion.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
activity—an action, act, step, and/or process or portion thereof.
adapter—a device used to effect operative compatibility between different parts of one or more pieces of an apparatus or system.
and/or—either in conjunction with or in alternative to.
apparatus—an appliance or device for a particular purpose.
article—a particular item or object.
associate—to join, connect together, and/or relate.
attraction—a force under the influence of which objects tend to move toward each other.
barrel—a tube of a gun through which a bullet is fired.
base—a portion of a frame that is coupled to a pair of sides and engages with a cabinet and slidable cover.
bearing—a device that supports, guides, and reduces the friction of motion between fixed and moving machine parts.
cabinet—a piece of furniture constructed to mount to a wall that has an appearance of not comprising a compartment.
can—is capable of, in at least some embodiments.
catch—a piece of an object that can restrain motion of the object relative to another object.
compartment—a space that is partitioned off.
comprising—including but not limited to.
configure—to make suitable or fit for a specific use or situation.
connect—to join or fasten together.
constructed to—made to and/or designed to.
coupling—to join together.
coupleable—capable of being joined, connected, and/or linked together.
coupling—linking in some fashion.
cover—a face that covers a cabinet opening.
define—to establish the outline, form, or structure of.
device—a machine, manufacture, and/or collection thereof.
dowel pin—a type of fastener used to hold an object in place.
enclosed—substantially surrounded.
expose—to uncover something.
firearm—a small arms weapon, as a pistol, from which a projectile is fired by gunpowder.
frame—a rigid structure joined so as to surround a substantially empty space, and used as a support for other parts of the rigid structure.
framed mirror—a reflective surface that is surrounded on its perimeter by an enclosure.
gun prong—a projecting bar that is sized smaller than a barrel of a firearm storable thereon.
household—a residence.
install—to connect or set in position and prepare for use.
magnet—a material or object that produces a magnetic field.
magnetic—capable of being attracted by a magnetic field.
may—is allowed and/or permitted to, in at least some embodiments.
method—a process, procedure, and/or collection of related activities for accomplishing something.
mirror—an object that reflects light in such a way that, for incident light in some range of wavelengths, the reflected light preserves many or most of the detailed physical characteristics of the original light.
object—a tangible thing.
object frame—a frame comprised by something.
open—allowing access to inside.
peg—a pin of wood or other material that can be fitted into something, as to hang things on.
picture—an image, illustration, or drawing that is mounted in a display frame.
picture frame—an enclosure that surrounds a perimeter of an image or piece of artwork that allows the image or piece of artwork to be placed on a wall of a building.
piece—a part of a larger device or system.
place—to put in a particular location and/or position.
plurality—the state of being plural and/or more than one.
position—a place occupied by something.
predetermined—established in advance.
provide—to furnish, supply, give, and/or make available.
prong—a pin projecting from a surface.
repeatedly—again and again; repetitively.
repulsion—a force under the influence of which objects tend to move away from each other.
resembles—looks substantially like.
responsive—reacting to an influence and/or impetus.
rod—a thin straight bar having a substantially circular cross-section.
rotatable—capable of turning about an axis.
rotate—to turn about an axis.
set—a related plurality.
slidable—constructed to move along in substantially continuous contact with a surface.
substantially—to a great extent or degree.
support—to bear the weight of, especially from below.
system—a collection of mechanisms, devices, machines, articles of manufacture, processes, data, and/or instructions, the collection designed to perform one or more specific functions.
tongue and groove—a construction via which two objects are releasably coupled together. One piece defines a pair of slots (the groove), one groove cut along each of two edges. The other piece has a ridge (the tongue) on each of two opposite edges. Each tongue projects a little less than the depth of the corresponding groove. The two pieces fit together closely as the piece comprising the ridges slides into the piece defining the grooves.
via—by way of and/or utilizing.
wall—a vertical construction with a length and height greater than a thickness and is used to at least partially enclose.
weight distribution—how mass is apportioned within an object.

NOTE

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- no characteristic, function, activity, or element is "essential";
- any elements can be integrated, segregated, and/or duplicated;
- any activity can be repeated, any activity can be performed by multiple entities, and/or any activity can be performed in multiple jurisdictions; and
- any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A cabinet comprising:
a cover;
a base;
a rotatable rod coupled to the base;
a gun prong coupled to the rotatable rod;
a prong magnet coupled to the gun prong;
a magnetic piece; and
a base magnet;
wherein, when the cover is opened to a predetermined position, the rotatable rod rotates to expose an article placed on the gun prong, the rotation of the rotatable rod caused by attraction between the prong magnet and the magnetic piece and repulsion between the prong magnet and the base magnet.

2. The cabinet of claim 1, further comprising:
a door prong, the door prong coupled to the rotatable rod, the door prong constructed to restrain the cover from motion after the cover is lifted to the predetermined position relative to the base.

3. The cabinet of claim 1, wherein:
the article is a firearm.

4. The cabinet of claim 1, wherein:
the magnetic piece is a magnet.

5. The cabinet of claim 1, wherein:
the cover is slidable.

6. The cabinet of claim 1, wherein:
the cover is rotatable.

7. The cabinet of claim 1, wherein:
the rotatable rod is coupled to the base via a pair of dowel pins.

8. The cabinet of claim 1, wherein:
the cabinet defines an aperture.

9. The cabinet of claim 1, wherein:
the cover engages with the base via a tongue and groove.

10. The cabinet of claim 1, wherein:
the article is a firearm.

11. The cabinet of claim 1, wherein:
the cabinet resembles a household cabinet.

12. The cabinet of claim 1, wherein:
the cabinet resembles a picture frame.

13. The cabinet of claim 1, wherein:
the cabinet resembles a framed mirror.

14. A cabinet comprising:
a cover;
a base;
a rotatable rod coupled to the base;
a gun prong coupled to the rotatable rod;
a prong magnet coupled to the gun prong; and
a base magnet; and
wherein, when the cover is opened to a predetermined position, the rotatable rod rotates to expose an article placed on the gun prong, rotation of the rotatable rod caused by repulsion between the prong magnet and the base magnet.

15. A cabinet comprising:
a cover;
a base;
a rotatable rod coupled to the base;
a gun prong coupled to the rotatable rod;
a prong magnet coupled to the gun prong; and
a magnetic piece; and
wherein, when the cover is opened to a predetermined position, the rotatable rod rotates to expose an article placed on the gun prong, rotation of the rotatable rod caused by attraction between the prong magnet and the magnetic piece.

* * * * *